US008720691B2

(12) United States Patent
Hu

(10) Patent No.: US 8,720,691 B2
(45) Date of Patent: May 13, 2014

(54) LOWER CUSHIONING STRUCTURE AND PACKAGE CUSHIONING STRUCTURE FOR DISPLAY PANEL

(75) Inventor: Qianshuang Hu, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 0 days.

(21) Appl. No.: 13/264,978

(22) PCT Filed: May 10, 2011

(86) PCT No.: PCT/CN2011/073906

§ 371 (c)(1), (2), (4) Date: Oct. 17, 2011

(87) PCT Pub. No.: WO2012/109822

PCT Pub. Date: Aug. 23, 2012

(65) Prior Publication Data

US 2012/0211398 A1 Aug. 23, 2012

(51) Int. Cl.
*B65D 81/02* (2006.01)

(52) U.S. Cl.
USPC ..... 206/587; 206/454; 206/594

(58) Field of Classification Search
USPC ..... 206/587, 454, 521, 320, 585, 524, 586, 206/592, 593, 594, 725, 523, 589, 588, 591
See application file for complete search history.

(56) References Cited

U.S. PATENT DOCUMENTS

| | | | | | |
|---|---|---|---|---|---|
| 1,792,627 | A * | 2/1931 | Bowersock | ..... | 206/591 |
| 3,356,209 | A * | 12/1967 | Pezely, Jr. | ..... | 206/523 |
| 3,701,465 | A * | 10/1972 | Richter | ..... | 206/521 |
| T927,008 | I4 * | 10/1974 | Sherman | ..... | 206/454 |
| 6,145,663 | A * | 11/2000 | Kim et al. | ..... | 206/454 |
| 6,811,028 | B2 * | 11/2004 | Kim et al. | ..... | 206/587 |
| 6,997,318 | B2 * | 2/2006 | Park | ..... | 206/454 |
| 7,578,390 | B2 * | 8/2009 | Ting | ..... | 206/454 |
| 7,604,121 | B1 * | 10/2009 | Tang et al. | ..... | 206/454 |
| 2005/0087470 | A1 * | 4/2005 | Chuang et al. | ..... | 206/503 |
| 2006/0226047 | A1 * | 10/2006 | Takagi | ..... | 206/725 |
| 2011/0056868 | A1 * | 3/2011 | Ting et al. | ..... | 206/587 |

FOREIGN PATENT DOCUMENTS

| | | | |
|---|---|---|---|
| CN | 201351012 | Y | 11/2009 |
| CN | 201534667 | U | 7/2010 |
| JP | 2003-72845 | A | 3/2003 |
| KR | 2003-0078534 | A | 10/2003 |

* cited by examiner

*Primary Examiner* — Jacob K Ackun
*Assistant Examiner* — Jenine Pagan
(74) *Attorney, Agent, or Firm* — Cheng-Ju Chiang

(57) ABSTRACT

A lower cushioning structure and a package cushioning structure for a display panel are disclosed. The lower cushioning structure comprises: a supporting frame, comprising a baseplate as well as a first side plate and a second side plate extending upwards from two opposite sides of the baseplate respectively; two first cushions, being disposed at a location where the first side plate of the supporting frame borders the baseplate and a location where the second side plate of the supporting frame borders the baseplate respectively; and two second cushions, being disposed on an inner wall of the first side plate and an inner wall of the second side plate of the supporting frame respectively, wherein the second cushions are located above the first cushions. The present invention has a low cost and can provide satisfactory cushioning for the display panel.

14 Claims, 4 Drawing Sheets

LOWER CUSHIONING STRUCTURE AND PACKAGE CUSHIONING STRUCTURE FOR DISPLAY PANEL

TECHNICAL FIELD

The present disclosure generally relates to the field of article packaging technologies, and particularly, to a lower cushioning structure and a package cushioning structure for a display panel.

BACKGROUND

Conventionally, during storage, transportation and production of display panels, necessary package cushioning structures must be used for purpose of fixation and protection. Particularly for large-sized display panels such as liquid crystal display (LCD) panels, they are usually arranged in the form of a stack and spaced apart from each other, so cushioning measures must be taken therebetween to prevent damage caused by impact.

Conventional solutions for package cushioning of the display panels are as follows:

Solution I: referring to FIG. 1, a corrugated cardboard 110 is dented, die cut, bonded, interdigitated and assembled, and is then put into a corrugated carton having both a cover and a bottom to cushion the display panels. Although this solution is environmental friendly, it has the following disadvantages: the corrugated cardboard is relatively stiff; when the carton drops onto the ground, corners of the display panels in contact with the corrugated cardboard are liable to deformation; furthermore, because the manufacturing process is complex and entirely relies on manual operation, it is time- and labor-consuming.

Solution II: referring to FIG. 2, a board 210 made of a low-density expandable polyethylene (EPE) is die cut and bonded, and then put into a corrugated carton 220 having both a cover and a bottom to cushion the display panels. This solution is environmental friendly and has a satisfactory cushioning effect. However, as the cushioning structure is made of the low-density EPE, spacings between the display panels cannot be made to be too small: because of the soft nature of EPE, a too small spacing would cause the display panels to collide with each other.

Solution III: referring to FIG. 3, for large-sized display panels of 42 inches and above, a cushioning structure made of a corrugated cardboard described above in Solution I or the EPE board 310 described above in Solution II is put into a paper mount 320 for cushioning purpose and then, as a whole, they are put into a corrugated carton having a cover but no bottom. This solution is advantageously suitable for package cushioning of large-sized display panels of 42 inches and above. Because the carton for package cushioning has a cover but no bottom, display panels are firstly put into the lower cushioning structure and then the carton is put on the lower cushioning structure; when the display panels are to be removed, operations can be performed in a reverse order. This solution makes it convenient to remove the display panels and also have the advantages of Solution I and Solution II described above. However, because the paper mount 320 has a certain thickness, so it occupies a certain amount of space in the width direction; furthermore, the paper mount 320 is more expensive than the cardboard, so this solution has the disadvantages of both Solution I and Solution II described above.

Solution IV: referring to FIG. 4, a box is made of an expandable polystyrene (EPS) material 410 to directly provide a cushioning effect. This solution is advantageous in that EPS is cheaper than EPE and the corrugated cardboard. However, it is not environmental friendly; especially, because use of EPS is prohibited in some countries, this may have an influence on export of products adopting such a package cushioning design. Additionally, EPS has a poorer cushioning performance than the corrugated cardboard and EPE.

Solution V: referring to FIG. 5, a cushioning structure is formed by attaching a low-density EPE structure 520 to a high-density EPE structure 510. This solution is advantageously suitable for large-sized display panels. Also, the carton for package cushioning has a cover but no bottom, so when display panels are to be put therein, display panels are firstly put into the lower cushioning structure and then the carton is put on the lower cushioning structure; and when the display panels are to be removed, operations can be performed in a reverse order. This solution makes it convenient to remove the display panels and has a satisfactory cushioning effect; furthermore, spacings between the display panels can be made to be smaller than when only the low-density EPE is used as a cushioning structure. However, this solution has the following disadvantages: use of the high-density cushioning structure 510 and the low-density cushioning structure 520 in combination leads to a complex production process that comprises too many steps, which drives the labor cost to be much higher; moreover, the high-density EPE structure 510 is costly, which makes the cost of the whole cushioning structure relatively high.

Additionally, the present inventor has also noted that, China Patent Application No. 200810070860.7 has disclosed a package cushioning structure, which comprises a corrugated cardboard and an elastic cushion. The corrugated cardboard is formed with a through-hole or a cutout, and the elastic cushion partially passes through the through-hole of the corrugated cardboard or is inserted into the cutout of the corrugated cardboard so that the elastic cushion and the corrugated cardboard are fixed together. This is convenient for assembly or removal.

SUMMARY OF THE INVENTION

A primary objective of the present invention is to provide a lower cushioning structure and a package cushioning structure for a display panel, which have a low cost and can provide satisfactory cushioning for the display panel.

To achieve the aforesaid objective, the present invention provides a package cushioning structure for a display panel, comprising: first cushions to be disposed at corners of the display panel; a second cushion to be disposed at a side of the display panel, wherein the first cushion is formed with first recesses for receiving a corner of the display panel, the second cushion is formed with second recesses for receiving a side of the display panel, and the first cushions have a better cushioning performance than the second cushions; and a supporting frame, comprising a baseplate and two side plates extending upwards from two opposite sides of the baseplate, wherein: each of the first cushions is disposed at a corner where one of the side plates of the supporting frame borders the baseplate; each of the second cushions is disposed on an inner wall of one of the side plates of the supporting frame; each of the first cushions is formed with a plurality of the first recesses arranged to be spaced apart from each other in a horizontal direction; each of the second cushions is formed with a plurality of the second recesses arranged to be spaced apart from each other in the horizontal direction; the first recesses correspond to the second recesses in a one-to-one correspondence relationship in the vertical direction; the first cushions and the second cushions are spaced apart from each other in the vertical direction; and a cushioning platform horizontally extending towards an interior of the supporting frame is connected to the first cushions and extends out from a side of the first cushions.

The supporting frame is further disposed in a corrugated carton.

The first cushions are low-density expandable polyethylene (EPE) cushions; and the second cushions are corrugated cardboard cushions.

To achieve the aforesaid objective, the present invention provides a lower cushioning structure for a display panel, comprising: a supporting frame, comprising a baseplate as well as a first side plate and a second side plate extending upwards from two opposite sides of the baseplate respectively; two first cushions, being disposed at a location where the first side plate of the supporting frame borders the baseplate and a location where the second side plate of the supporting frame borders the baseplate respectively; and two second cushions, being disposed on an inner wall of the first side plate and an inner wall of the second side plate of the supporting frame respectively, wherein the second cushions are located above the first cushions, wherein: each of the first cushions is formed, on an inner sidewall thereof, with a row of vertical first recesses spaced apart from each other in a horizontal direction; each of the second cushions is formed, on an inner sidewall thereof, with a row of vertical second recesses spaced apart from each other in the horizontal direction; the first recesses correspond to the second recesses in a one-to-one correspondence relationship in the vertical direction; and the first cushions have a hardness smaller than the second cushions.

The first cushions are low-density EPE cushions; and the second cushions are corrugated cardboard cushions.

The structure comprises a third side plate and a fourth side plate extending upwards from the other two opposite sides of the baseplate, wherein the first side plate, the second side plate, the third side plate and the fourth side plate enclose a cavity; each of the first cushions is formed with protrusions on an outer sidewall opposite to the first recesses; and each of the first side plate and the second side plate is formed with through-holes for the protrusions to be snap-fitted therein.

The first cushions and the second cushions are spaced apart from each other in the vertical direction.

The supporting frame is further disposed in a corrugated carton.

The first cushions are low-density EPE cushions; and the second cushions are corrugated cardboard cushions.

To achieve the aforesaid objective, the present invention further provides a package cushioning structure for a display panel, comprising: first cushions to be disposed at corners of the display panel; and second cushions to be disposed at sides of the display panel, wherein: each of the first cushions is formed with first recesses for receiving a corner of the display panel; each of the second cushions is formed with second recesses for receiving a side of the display panel; and the first cushions have a better cushioning performance than the second cushions.

The structure further comprises: a supporting frame, comprising a baseplate and side plates extending upwards from two opposite sides of the baseplate, wherein each of the first cushions is disposed at a corner where one of the side plates of the supporting frame borders the baseplate; each of the second cushions is disposed on an inner wall of one of the side plates of the supporting frame; each of the first cushions has a plurality of first recesses spaced apart from each other in a horizontal direction; each of the second cushions has a plurality of second recesses spaced apart from each other in the horizontal direction; and the first recesses correspond to the second recesses in a one-to-one correspondence relationship in a vertical direction.

The supporting frame is further disposed in a corrugated carton.

The first cushions and the second cushions are spaced apart from each other in the vertical direction.

A cushioning platform horizontally extending towards an interior of the supporting frame is connected to the first cushions and extends out from a side of the first cushions.

The first cushions are low-density EPE cushions; and the second cushions are corrugated cardboard cushions.

The present invention has the following benefits. As compared to the conventional package cushioning structures for a display panel which have either a high cost or a poor cushioning effect, the package cushioning structure and the lower cushioning structure of the present invention use two kinds of cushions having different cushioning performances. Specifically, the first cushions have a small hardness or high cushioning performance, so they are adapted to be disposed at corners of the display panels to effectively protect the corners of the display panels from being deformed when the package drops to the ground or is impacted. On the other hand, to solve the problem that an excessive compression of the first cushions having a low density or high cushioning performance might cause collisions between the display panels, the second cushions having a poorer cushioning performance or a higher hardness are disposed at sides of the display panels. Thus, when the display panels move close to each other due to impact, the second cushions can provide an effective separation effect by virtue of the high hardness thereof, thus preventing damage caused by collisions between adjacent display panels. Meanwhile, owing to the effect of the second cushions, spacings between the display panels can be made to be small enough without having to worry about occurrence of collisions between the display panels. In this way, more display panels can be put in a unit volume to save both the transportation cost and the package cost.

Additionally, in an embodiment of the present invention, the first cushions are EPE cushions and the second cushions are corrugated cardboard cushions. This embodiment has advantages of both the low-density EPE which has a better cushioning performance and the corrugated cardboard which has a higher hardness than the low-density EPE. Specifically, by folding a corrugated cardboard into a structure that can separate different display panels from each other and cushion the display panels and then attaching the structure onto a side of another corrugated cardboard or a paper mount to fix the display panels, two adjacent display can have a small spacing therebetween without colliding with each other; and by forming the cushioning structure of the low-density EPE, the cushioning structure can provide a better cushioning effect for the two lower corners of each display panel. Thus, even when the display panel drops to the ground, the corners thereof will not be deformed. Moreover, use of raw materials can be reduced in the whole cushioning structure.

Additionally, in another embodiment of the present invention, the second cushions formed by a folded corrugated cardboard and the first cushions formed of EPE may be spaced apart from but not adjoin each other. Through use of the corrugated cardboard and EPE in combination, both a better cushioning effect and a small spacing between display panels can be obtained. In this way, more display panels can be put in a unit volume to save both the transportation cost and the package cost.

BRIEF DESCRIPTION OF THE DRAWINGS

The components in the drawings are not necessarily drawn to scale, the emphasis instead being placed upon clearly illustrating the principles of at least one embodiment of the present disclosure. In the drawings, like reference numerals designate corresponding parts throughout various views, and all the views are schematic.

DETAILED DESCRIPTION OF EMBODIMENTS

Reference will now be made to the drawings to describe preferred and exemplary embodiments of the present disclosure in detail.

Figure 1:
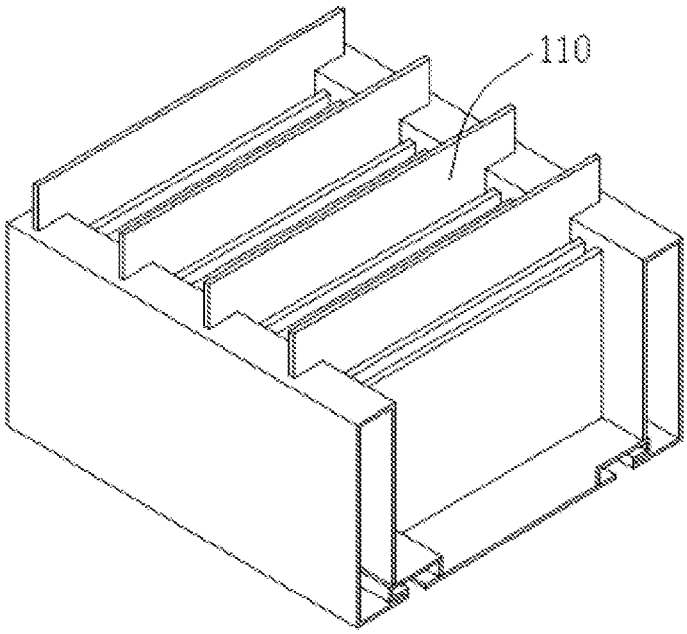
FIG. 1 (Prior Art)
FIG. 1 is a schematic view of a first conventional package cushioning structure.
Figure 2:
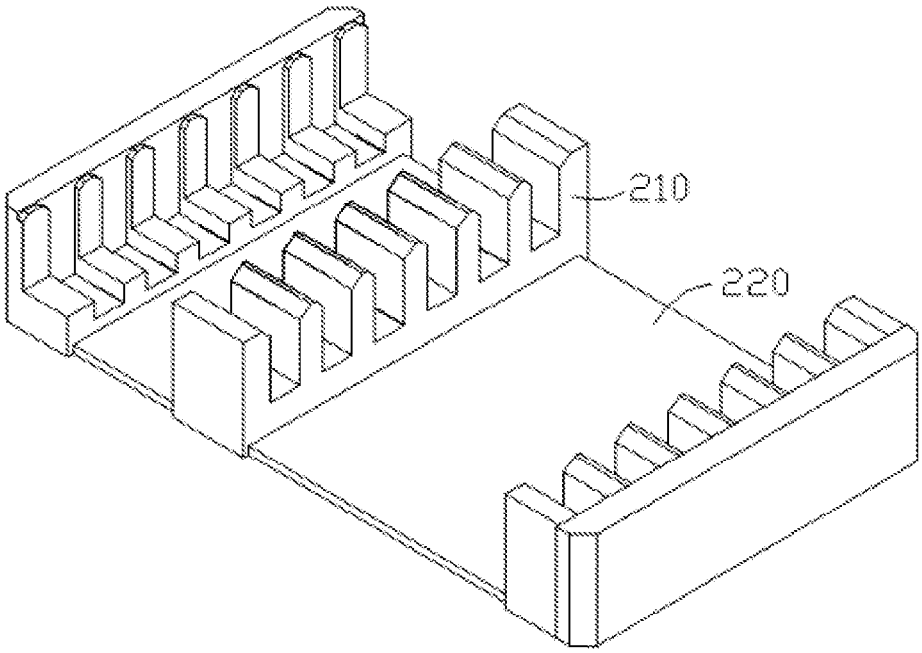
FIG. 2 (Prior Art)
FIG. 2 is a schematic view of a second conventional package cushioning structure.
Figure 3:
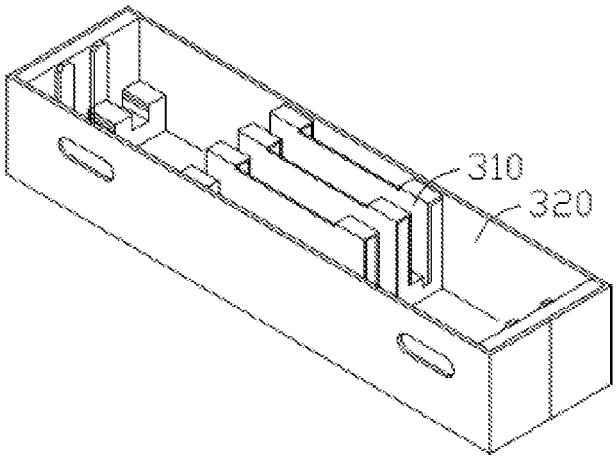
FIG. 3 (Prior Art)
FIG. 3 is a schematic view of a third conventional package cushioning structure.
Figure 4:
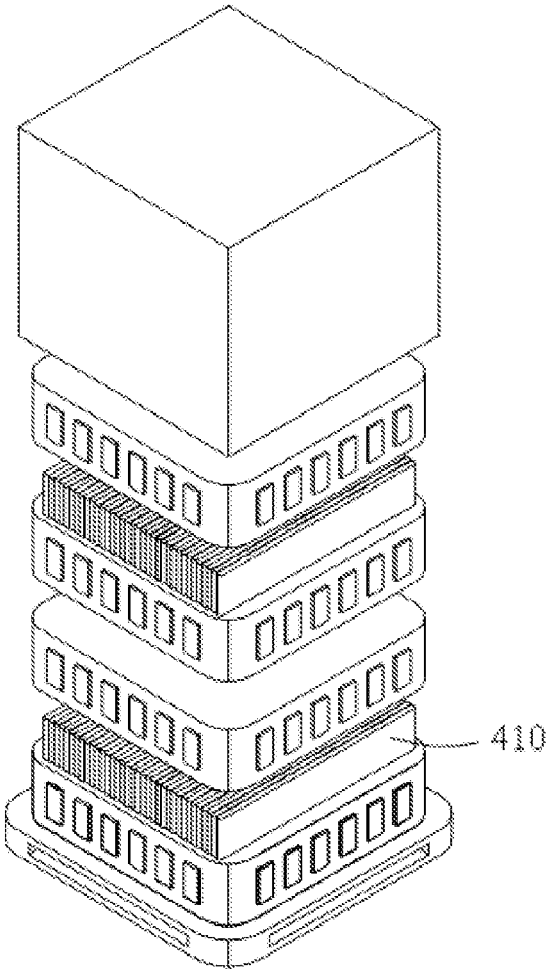
FIG. 4 (Prior Art)
FIG. 4 is a schematic view of a fourth conventional package cushioning structure.
Figure 5:
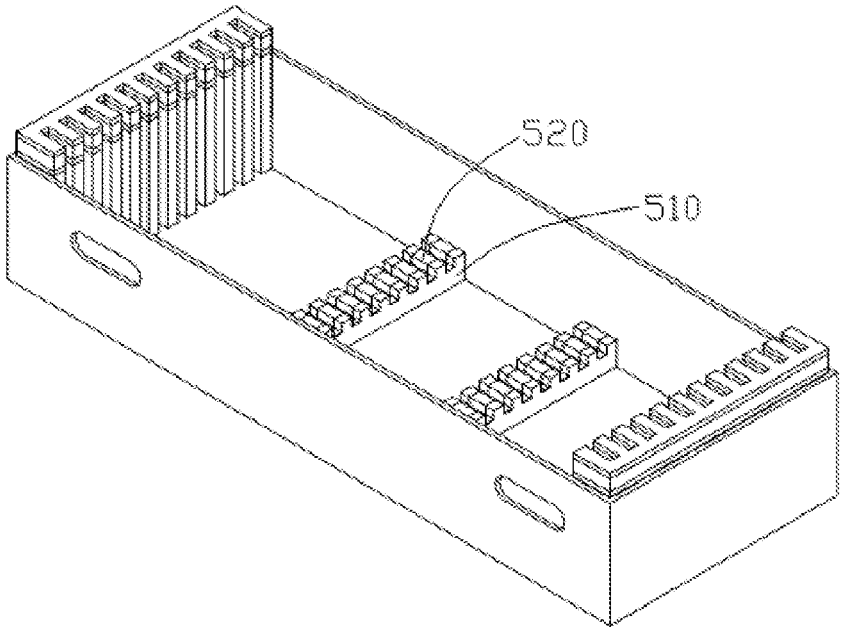
FIG. 5 (Prior Art)
FIG. 5 is a schematic view of a fifth conventional package cushioning structure.
Figure 6:
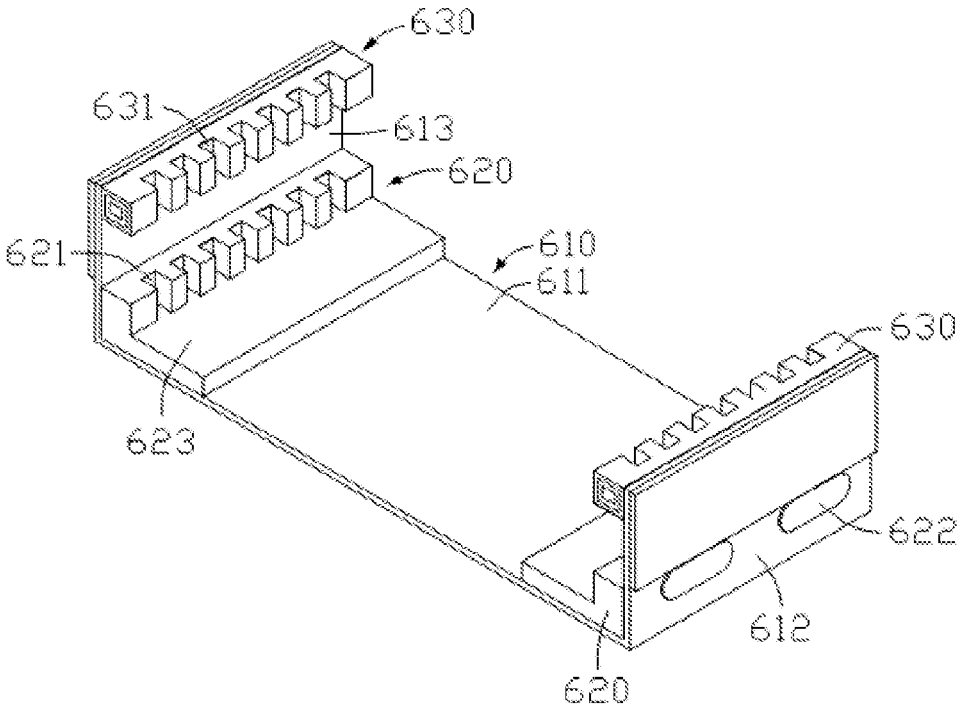
FIG. 6 is a schematic view of a lower cushioning structure for a display panel according to the present invention.

Referring to FIG. 6, a lower cushioning structure for a display panel according to an embodiment of the present invention comprises:

a supporting frame 610, comprising a baseplate 611 as well as a first side plate 612 and a second side plate 613 extending upwards from two opposite sides of the baseplate 611;

two first cushions 620, being disposed at a position where the first side plate 612 of the supporting frame 610 borders the baseplate 611 and a position where the second side plate 613 borders the baseplate 611 respectively;

two second cushions 630, being disposed on an inner wall of the first side plate 612 and an inner wall of the second side plate 613 respectively, wherein the second cushions 630 are located above the first cushions 620;

wherein, each of the first cushions 620 is formed, on an inner sidewall thereof, with a row of vertical first recesses 621 that are spaced apart in a horizontal direction;

each of the second cushions 630 is formed, on an inner sidewall thereof, with a row of vertical second recesses 631 that are spaced apart in the horizontal direction;

the first recesses 621 corresponds to the second recesses 631 in a one-to-one correspondence relationship; and the first cushions 620 have a hardness smaller than that of the second cushions 630.

In use, a display panel (not shown) is vertically placed into the lower cushioning structure in such a way that two lower corners of the display panel are embedded into the first recesses 621 of the first cushions 620 and side portions of the display panel are embedded into the second recesses 631 of the second cushions 630. Thus, the display panel can be fixed and cushioned during the storage or transportation process.

As can be appreciated from the above description, two different kinds of cushions are used in this embodiment. Specifically, the first cushions 620 have a small hardness, so they are adapted to be disposed at corners of the display panel to effectively protect the corners of the display panel from being deformed when the display panel drops to the ground or is impacted. On the other hand, to solve the problem that an excessive compression of the first cushions 620 having a low hardness might cause collisions between the display panels, the second cushions 630 having a higher hardness are disposed at sides of the display panels. Thus, when the display panels move close to each other due to impact, the second cushions 630 can serve as a spacer having a cushioning function and provide an effective separation effect by virtue of the high hardness thereof, thus preventing damage caused by collisions between adjacent display panels. Meanwhile, owing to the effect of the second cushions 630, spacings between the display panels can be made to be small enough without having to worry about occurrence of collisions between the display panels. In this way, more display panels can be put in a unit volume to save both the transportation cost and the package cost.

In another embodiment of the present invention, the first cushions 620 are low-density expandable polyethylene (EPE) cushions, while the second cushions 630 are corrugated cardboard cushions.

Of course, the first cushions 620 are not limited to low-density EPE cushions, but may also be of EPS or even EPE of a bit higher density; and the second cushions 630 are not limited to corrugated cardboard cushions, but may also be of high-density EPE or other materials with a high density and a high hardness.

In another embodiment of the present invention, the lower cushioning structure further comprises a corrugated carton (not shown) having both a cover and a bottom. The corrugated carton is disposed around the supporting frame 610 to improve the strength of the whole structure. This design is more suitable for packaging display panels of smaller than 42 inches. Of course, the corrugated carton may also be disposed to encircle the supporting frame 610.

Figure 7:
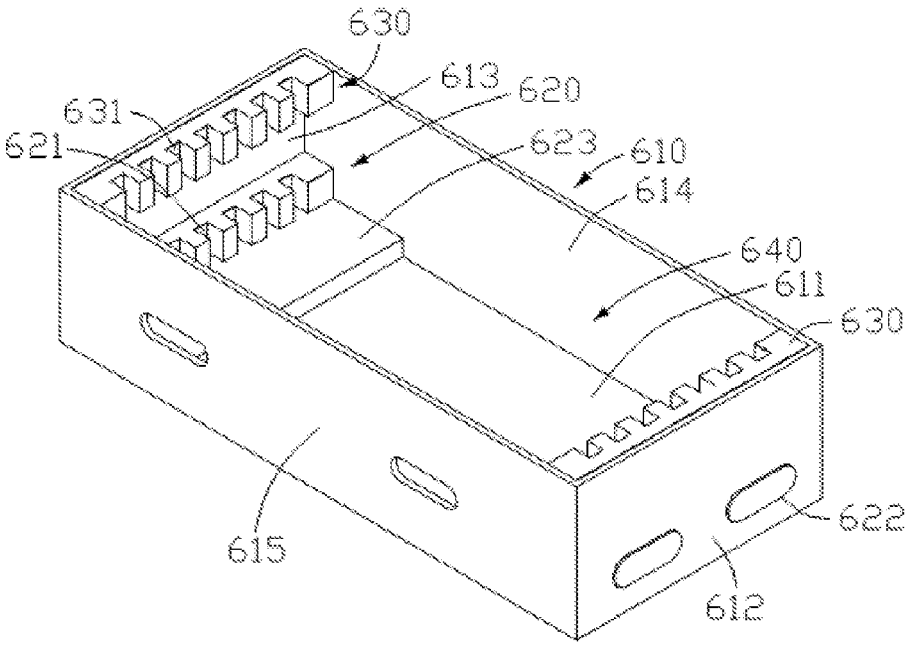
FIG. 7 is a schematic view of a package cushioning structure for a display panel according to the present invention.

Referring to FIG. 7, in another embodiment of the present invention:

the structure comprises a third side plate 614 and a fourth side plate 615 extending upwards from the other two opposite sides of the baseplate 611, wherein the first side plate 612, the second side plate 613, the third side plate 614 and the fourth side plate 615 sequentially enclose a cavity 640, with an opening of the cavity 640 being closed by the baseplate 611.

Each of the first cushions 620 is formed with protrusions 622 on an outer sidewall opposite to the first recesses 621.

Each of the first side plate 612 and the second side plate 613 is formed with through-holes (not shown) for the protrusions 622 to be snap-fitted therein.

A five-layer corrugated cardboard may be used as a material of the first side plate 612 and the second side plate 613, and the protrusions 622 of the two first cushions 620 are snap-fitted into the through-holes of the first side plate 612 and the second side plate 613. In this way, it is unnecessary to bond them together, which is convenient for recovery. The five-layer corrugated cardboard described above is only for illustrative purpose, and it is not limited to a five-layer structure or to a corrugated cardboard in other embodiments of the present invention.

In use of this embodiment, the supporting frame 610 in the form of a paper mount may be formed with through-holes in the side surfaces thereof (i.e., the firs side plate 612 and the second side plate 613) in order to lock the first cushions 620 into place. For example, the through-holes in the first side plate 612 and the second side plate 613 may be formed through punching. The second cushions 630 may be directly attached to upper portions of the first side plate 612 and the second side plate 613, and then a corrugated carton having a cover but no bottom is disposed around the supporting frame 610 to enhance the strength of the whole structure. This design is more suitable for packaging display panels of 42 inches and above.

Of course, the lower cushioning structure for a display panel according to the present invention may also be termed as a package cushioning structure for a display panel. For example, referring to FIG. 6, the present invention further provides a package cushioning structure for a display panel, comprising:

first cushions 620 to be disposed at corners of the display panel; and second cushions 630 to be disposed at sides of the display panel, wherein:

each of the first cushions 620 is formed with first recesses 621 for receiving a corner of the display panel;

each of the second cushion 630 is formed with second recesses 631 for receiving a side of the display panel; and the first cushions 620 have a better cushioning performance than the second cushions 630.

In use, the first cushions 620 are disposed at corners of the display panel and the display panel is vertically placed into the lower cushioning structure with two lower corners of the display panel being embedded into the first recesses 621 of the first cushions 620; and the second cushions 630 are disposed at sides of the display panel with side portions of the display panel being embedded into the second recesses 631 of the second cushions 630. Thus, the display panel can be fixed and cushioned during the storage or transportation process.

As can be appreciated from the above description, the first cushions 620 and the second cushions 630 are designed to have different cushioning performances and disposed at different positions. By disposing appropriate types of cushions at appropriate positions, effective cushioning can be provided to prevent deformation of corners of the display panel when the display panel drops to the ground or impacted, and effective separation can be provided between adjacent display panels to prevent damage due to collisions therebetween.

Meanwhile, owing to the effect of the second cushions 630, spacings between the display panels can be made to be small enough without having to worry about occurrence of collisions between the display panels. In this way, more display panels can be put in a unit volume to save both the transportation cost and the package cost.

By "the first cushions 620 have a better cushioning performance than the second cushions 630", it may mean that the first cushions 620 have a hardness smaller than that of the second cushions 630, or that the first cushions 620 has both a hardness smaller than that of the second cushions 630 and a density smaller than that of the second cushions 630; alternatively, it may also mean differences in other parameters that reflect the cushioning performance.

Referring to FIG. 7, in another embodiment, the package cushioning structure for a display panel comprises:

a supporting frame 610, comprising a baseplate 611 and side plates (612, 613, 614, 615) extending upwards from four sides of the base plate 611;

each of the first cushions 620 is disposed at a corner where one of the side plates of the supporting frame 610 borders the baseplate 611;

each of the second cushions 630 is disposed on an inner wall of one of the side plates of the supporting frame 610;

each of the first cushions 620 has a plurality of first recesses 621 spaced apart from each other in a horizontal direction;

each of the second cushions 630 has a plurality of second recesses 631 spaced apart from each other in the horizontal direction; and the first recesses 621 correspond to the second recesses 631 in a one-to-one correspondence relationship in the vertical direction.

By providing a plurality of first recesses 621 and a plurality of second recesses 631, a plurality of display panels can be placed in the form of a stack; meanwhile, the design of the supporting frame 610 allows use of the supporting frame 610 as a paper mount, making it convenient to put the structure into a packaging box.

In another embodiment of the package cushioning structure for a display panel, the supporting frame 610 is a corrugated paper mount, which is further disposed in a corrugated carton. The corrugated carton may have a cover but no bottom.

In another embodiment of the package cushioning structure for a display panel, the first cushions 620 and the second cushions 630 are arranged to be spaced apart from each other in the vertical direction. This can save use of materials and ensure adequate cushioning and separating functions. Of course, the first cushions 620 and the second cushions 630 may also not be arranged to be spaced apart from each other.

In another embodiment of the package cushioning structure for a display panel, a cushioning platform 623 horizontally extending towards an interior of the supporting frame 610 is connected to the first cushions 620 and extends out from a side of the first cushions 620. The cushioning platform 623 may be used to further cushion the bottom side of the display panels.

In another embodiment of the package cushioning structure for a display panel, the first cushions 620 are low-density EPE cushions, while the second cushions 630 are corrugated cardboard cushions.

In the embodiment where low-density EPE cushions are used as the first cushions 620, the corrugated cardboard cushions are used as the second cushions 630 and the first cushions and the second cushions are spaced apart, the second cushions 630 formed by a folded corrugated cardboard and the adjacent first cushion 620 made of EPE have a spacing therebetween but are not attached to each other. In such an embodiment, through use of the corrugated cardboard and EPE in combination, both a better cushioning effect and a reduced spacing between display panels can be achieved; in this way, more display panels can be put in a unit volume to save both the transportation cost and the package cost.

Hereinbelow, with a 32-inch display panel as an example, an embodiment of the present invention and a conventional design will be described respectively to illustrate how to lower the cost on the premise of providing an expected cushioning effect.

1) A Case Where an Embodiment of the Present Invention is Adopted

The 32-inch display panel has a width of 736 mm, a height of 433 mm and a thickness of 17 mm; the first recesses 621 of the first cushions 620 and the second recesses 631 of the second cushions 630 are both designed to have a recess width of 19 mm; and a spacing of 25 mm exists between individual recesses.

The corrugated carton has a length of 818 mm, a width of 380 mm and a height of 517 mm. Such a corrugated carton can have seven display panels contained therein. A pallet for supporting the corrugated carton has planar dimensions of 1150 mm*848 mm, so three corrugated cartons may be disposed flat as one layer on the pallet. Three layers in total can be stacked on the pallet. Therefore, each pallet can support 7*3*3=63 display panels in total. If a 40-yard standard container is used for transportation, 2*14 pallets and, consequently, 2*14*63=1764 display panels can be transported in one container.

Assume that the cost of one package of this design is X dollars, and in consideration of the cost of pallets and other auxiliary packaging materials such as labels and wrapping films, the total packaging cost for display panels of one container is about (X+Y) dollars. Then, the average packaging cost for each display panel is (X+Y)/1764 dollars. Assuming that transportation fees for a 40-yard standard container are Z dollars, the average transportation fee for each display panel will be Z/1764 dollars.

2) A Case Where the Conventional Solution II is Adopted

The 32-inch display panel has a width of 736 mm, a height of 433 mm and a thickness of 17 mm; the first recesses 621 of the first cushions 620 and the second recesses 631 of the second cushions 630 are both designed to have a recess width of 19 mm; and a spacing of 30 mm exists between individual recesses (30 mm is the minimum spacing required to avoid collision between two adjacent display panels).

The corrugated carton has a length of 818 mm, a width of 380 mm and a height of 517 mm. Such a corrugated carton can have six display panels contained therein. A pallet for supporting the corrugated carton has planar dimensions of 1150 mm*848 mm, so three corrugated cartons may be disposed flat as one layer on the pallet. Three layers in total can be stacked on the pallet. Therefore, each pallet can support 6*3*3=54 display panels in total. If a 40-yard standard container is used for transportation, 2*14 pallets and, consequently, 2*14*54=1512 display panels can be transported in one container.

Assume that the cost of one package of this design is about X dollars, and in consideration of the cost of pallets and other auxiliary packaging materials such as labels and wrapping films, the total packaging cost for display panels of one container is about (X+Y) dollars. Then, the average packaging cost for each display panel is (X+Y)/1512 dollars. Assuming that transportation fees for a 40-yard standard container are Z dollars, the average transportation fee for each display panel will be Z/1512 dollars.

Through comparison between the two cases described above, it can be concluded that:

1) Difference in the packaging cost: the packaging cost of the conventional Solution II is higher than that of the embodiment of the present invention by:

$$(X+Y)/1512-(X+Y)/1764>0;$$

2) Difference in the transportation cost: the transportation cost of the conventional Solution II is higher than that of the embodiment of the present invention by:

$$Z/1512-Z/1764>0.$$

Here, the value of X+Y may be determined according to quotations of packaging material suppliers, and the value of Z may be determined according to the transportation means and transportation distance. As can be known from the above conclusions, by adopting the embodiment of the present invention, both the packaging cost and the transportation cost can be generally reduced to result in better cost effectiveness.

Figure 8:
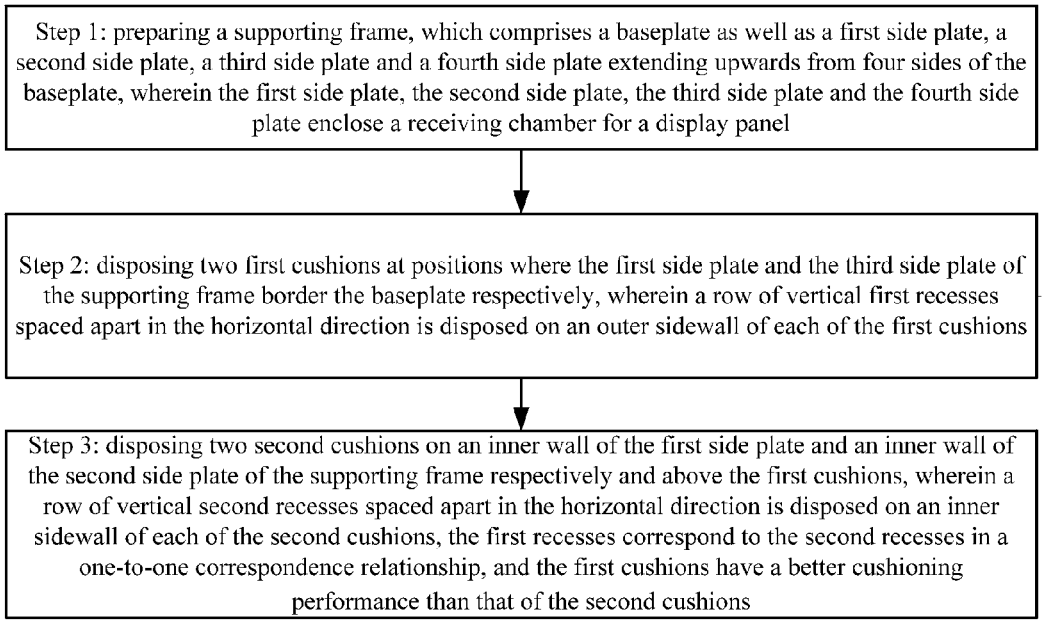
FIG. 8 is a flowchart diagram of a manufacturing method of a package for a display panel according to the present invention.

Referring to FIG. 6 and FIG. 8 together, the present invention further provides a manufacturing method of a package for a display panel, which comprises the following steps of:

Step 1: preparing a supporting frame 610, which comprises a baseplate 611 as well as a first side plate 612 and a second side plate 613 extending upwards from two opposite sides of the baseplate 611;

Step 2: disposing two first cushions 620 at positions where the first side plate 612 and the second side plate 614 of the supporting frame 610 border the baseplate 611 respectively, wherein a row of vertical first recesses 621 spaced apart in the horizontal direction is disposed on an inner wall of each of the first cushions 620;

Step 3: disposing two second cushions 630 on an inner wall of the first side plate 612 and an inner wall of the second side plate 614 of the supporting frame 610 respectively and above the first cushions, wherein a row of vertical second recesses 631 spaced apart in the horizontal direction is disposed on an inner wall of each of the second cushions 630, the first recesses 621 correspond to the second recesses 631 in a one-to-one correspondence relationship, and the first cushions 620 have a better cushioning performance than that of the second cushions 630.

wherein, a five-layer corrugated cardboard may be used as a material of the first side plate 612 and the second side plate 613, and the protrusions 622 of the two first cushions 620 that have been attached are snap-fitted into the through-holes of the first side plate 612 and the second side plate 613 which have been dented and die cut. In this way, it is unnecessary to bond them together, which is convenient for recovery. The first cushions 620 may be formed by folding a multi-layer corrugated cardboard to form the structures of the first recesses 621.

The five-layer corrugated cardboard described above is only for illustrative purpose, and it is not limited to a five-layer structure or to a corrugated cardboard in other embodiments of the present invention.

In various embodiments of the present invention, the baseplate 611 may be of a quadrilateral form such as a rectangular form or a rectangular form with rounded corners. By the "positions where the first side plate 612 or the second side plate 613 borders the baseplate 611", it may mean portions of the first side plate 612 or the second side plate 613 that adjoin the baseplate 611, or portions of the baseplate 611 that adjoin the first side plate 612 or the second side plate 613, or a corner where the first side plate 612 or the second side plate 613 borders the baseplate 611.

By the "corner" described in the aforesaid embodiments or the "corner" of the display panel, it may mean a corner where two adjacent sides intersect with each other or a portion of one side that is adjacent to the other side.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A package cushioning structure for a display panel, comprising:

first cushions to be disposed at corners of the display panel;

second cushions to be disposed at sides of the display panel; and a supporting frame;

wherein: the first cushions and the second cushions are spaced apart from each other in a vertical direction;

each of the first cushions is formed with a plurality of first recesses for receiving a corner of the display panel, wherein the first recesses are arranged to be spaced apart from each other in a horizontal direction;

each of the second cushions is formed with a plurality of second recesses for receiving a side of the display panel, wherein the second recesses are arranged to be spaced apart from each other in the horizontal direction;

the first recesses correspond to the second recesses in a one-to-one correspondence relationship in the vertical direction;

the supporting frame comprises a baseplate and side plates extending upwards from two opposite sides of the baseplate;

each of the first cushions is disposed at a corner where one of the side plates borders the baseplate;

each of the second cushions is disposed on an inner wall of one of the side plates of the supporting frame; and a cushioning platform horizontally extending towards an interior of the supporting frame is connected to the first cushions and extends out from a side of the first cushions.

2. The structure of claim 1, wherein: the supporting frame is further disposed in a corrugated carton.

3. The structure of claim 2, wherein: the first cushions are expandable polyethylene cushions; and the second cushions are corrugated cardboard cushions.

4. A lower cushioning structure for a display panel, comprising:

a supporting frame, comprising a baseplate as well as a first side plate and a second side plate extending upwards from two opposite sides of the baseplate respectively;

two first cushions, being disposed at a location where the first side plate of the supporting frame borders the baseplate and a location where the second side plate of the supporting frame borders the baseplate respectively; and two second cushions, being disposed on an inner wall of the first side plate and an inner wall of the second side plate of the supporting frame respectively, wherein the second cushions are located above the first cushions;

wherein: each of the first cushions is formed, on an inner sidewall thereof, with a row of vertical first recesses spaced apart from each other in a horizontal direction;

each of the second cushions is formed, on an inner sidewall thereof, with a row of vertical second recesses spaced apart from each other in the horizontal direction;

the first recesses correspond to the second recesses in a one-to-one correspondence relationship in a vertical direction; and the first cushions have a hardness smaller than the second cushions.

5. The structure of claim 4, wherein: the first cushions are expandable polyethylene (EPE) cushions; and the second cushions are corrugated cardboard cushions.

6. The structure of claim 4, wherein: the structure comprises a third side plate and a fourth side plate extending upwards from the other two opposite sides of the baseplate, wherein the first side plate, the second side plate, the third side plate and the fourth side plate enclose a cavity; each of the first cushions is formed with protrusions on an outer sidewall opposite to the first recesses.

7. The structure of claim 4, wherein: the first cushions and the second cushions are spaced apart from each other in the vertical direction.

8. The structure of claim 4, wherein: a cushioning platform horizontally extending towards an interior of the supporting frame is connected to the first cushions and extends out from a side of the first cushions.

9. The structure of claim 4, wherein: the supporting frame is further disposed in a corrugated carton.

10. A package cushioning structure for a display panel, comprising:

a supporting frame comprising a baseplate and side plates extending upwards from two opposite sides of the baseplate;

first cushions to be disposed at corners of the display panel; and second cushions to be disposed at sides of the display panel;

wherein: each of the first cushions is formed with first recesses for receiving a corner of the display panel;

each of the second cushions is formed with second recesses for receiving a side of the display panel;

wherein each of the first cushions is disposed at a corner where one of the side plates of the supporting frame borders the baseplate; each of the second cushions is disposed on an inner wall of one of the side plates of the supporting frame; each of the first cushions has a plurality of first recesses spaced apart from each other in a horizontal direction; each of the second cushions has a plurality of second recesses spaced apart from each other in the horizontal direction; and the first recesses correspond to the second recesses in a one-to-one correspondence relationship in a vertical direction.

11. The structure of claim 10, wherein: the supporting frame is further disposed in a corrugated carton.

12. The structure of claim 11, wherein: the first cushions and the second cushions are spaced apart from each other in the vertical direction.

13. The structure of claim 11, wherein: a cushioning platform horizontally extending towards an interior of the supporting frame is connected to the first cushions and extends out from a side of the first cushions.

14. The structure of claim 11, wherein: the first cushions are expandable polyethylene (EPE) cushions; and the second cushions are corrugated cardboard cushions.

* * * * *